United States Patent [19]

Pawlak et al.

[11] 4,128,443

[45] Dec. 5, 1978

[54] DEFLAGRATING PROPELLANT COMPOSITIONS

[76] Inventors: Daniel E. Pawlak, 5902 212th SE., Issaquah, Wash. 98027; Michael Levenson, 2591 Queenston Rd., Cleveland Heights, Ohio 44118

[21] Appl. No.: 598,850

[22] Filed: Jul. 24, 1975

[51] Int. Cl.[2] ..... C06B 31/10; C06B 31/06; C06B 29/12; C06B 29/06

[52] U.S. Cl. ..... 149/71; 149/73; 149/82; 149/86

[58] Field of Search ..... 149/71, 72, 73, 76, 149/82, 83, 85, 86; 102/101, 103, 104

[56] References Cited

U.S. PATENT DOCUMENTS

| | | | |
|---|---|---|---|
| 792,511 | 6/1905 | Frank | 149/82 |
| 1,882,853 | 10/1932 | McIntyre | 149/73 |
| 2,423,427 | 7/1947 | Payn | 149/73 |
| 3,092,528 | 6/1963 | Loving | 149/73 |
| 3,366,053 | 1/1968 | Griffith | 149/43 |
| 3,449,181 | 6/1969 | Armantrout | 149/43 |
| 3,491,690 | 1/1970 | Knight | 102/101 |
| 3,647,393 | 3/1972 | Leising | 149/72 |
| 3,660,546 | 5/1972 | Lovold | 264/3 C |
| 3,862,866 | 1/1975 | Timmerman | 149/21 |
| 3,880,595 | 4/1975 | Timmerman | 149/83 |
| 3,980,741 | 9/1976 | Lovold | 149/72 |

*Primary Examiner*—Samuel W. Engle
*Assistant Examiner*—Donald P. Walsh

[57] ABSTRACT

Gas-forming deflagrating compositions which produce relatively low peak pressures and impart high velocity to projectiles are formed by incorporation of from about 1 to about 25 percent of water in an oxidizer-fuel mixture.

8 Claims, 1 Drawing Figure

FIGURE I
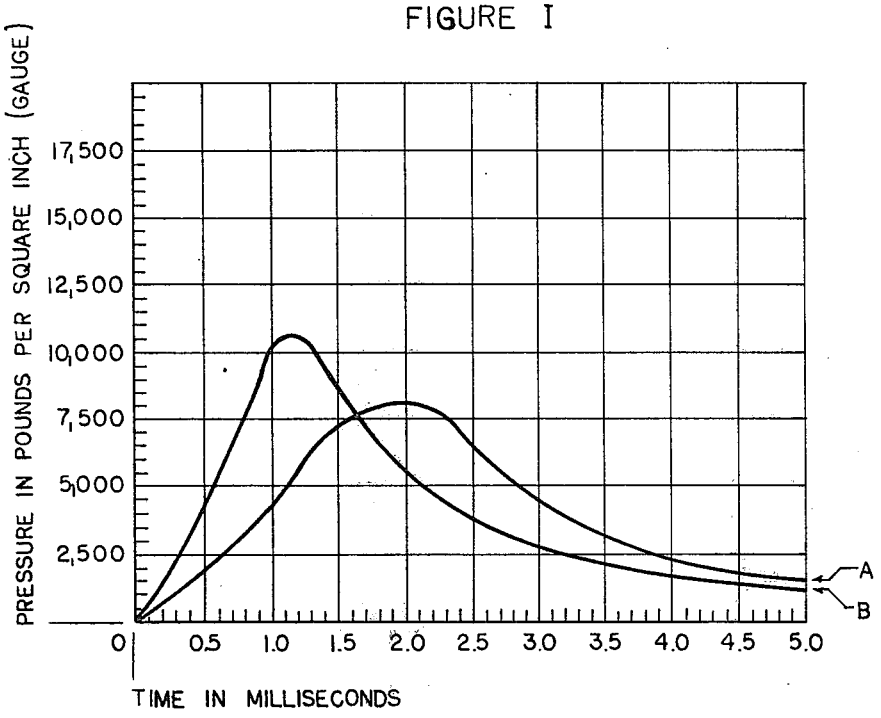

DEFLAGRATING PROPELLANT COMPOSITIONS

BACKGROUND OF THE INVENTION

This invention relates to propellants useful in the art of firearms, munitions, pyrotechnics, and the like, and particularly relates to gas-forming, deflagrating compositions and methods for their production.

Black powder is the name applied to deflagrating compositions consisting essentially of an intimate mixture of potassium nitrate, sulfur and charcoal in the approximate proportion 75:10:15. Other than minor variations which have been made to produce certain desired effects, this general composition has not changed since about 1560. Black powder has largely been replaced by smokeless powder as a propellant for firearms ammunition, primarily because the latter is safer to handle and store and does not produce "fouling" or corrosion of the firearm which are both characteristic of black powder. However, the gas pressures produced by the burning of smokeless powders are many times greater than those produced by black powder, and as a result, smokeless powder requires a considerably stronger firearm and also much more care in the amount of propellant used in order that dangerous pressure levels are not produced.

The art has long sought a deflagrating propellant composition which combines the low pressure characteristics of black powder and the safe handling and storage properties of smokeless powder.

A further undesirable characteristic of black powder is the composition of its combustion products. A desirable propellant yields a very high percentage of low-molecular weight gases in its combustion products in order to impart the most efficient propulsion to a projectile. Upon combustion, black powder characteristically produces about 43 percent of gas, 56 percent of solids, and about 1 percent of water vapor. The large amount of solid combustion products results in poor efficiency and in the copious quantities of smoke which is characteristic of black powder. The combustion products of smokeless powder, on the other hand, are almost entirely gases which are useful for efficient propulsion.

Yet another disadvantage of black powder resides in the extremely heavy and expensive equipment required in its manufacture. Thus, the composition is commonly mixed, milled under massive stone wheels, pressed in a hydraulic press at about 1200 p.s.i., granulated by crushing the presscake, and then polished and graded. The multi-step operation requires not only considerable expense in investment for equipment, but also it is time-consuming and extremely dangerous in its operation. Thus, the art is in need of a simpler, less expensive, and safer method to produce deflagrating compositions of the lower-pressure, or "black powder" type.

An important characteristic of propellants which determines their usefulness in the firearms art (including small arms, artillery, and kindred military weapons) is its rate of burning. The U.S. Army Ordnance Corps has shown that such propellants are required to burn rather slowly in order not to produce excessive pressures in the bore of a gun. The pressure must be sufficient to impart desirable velocity to the projectile and not drop too rapidly as the projectile travels toward the muzzle.

The advantage offered by our compositions is their unique property of imparting high velocity to a projectile within a firearm or the like without the concomitant development of dangerously high pressure within the chamber. It is known in the art that the muzzle velocity of a bullet or similar projectile leaving the barrel of a firearm is proportional not to the peak pressure developed within the bore, but rather to the integrated area under the pressure-time curve. [See "Modern Pressure Measuring" by Dan Pawlak, HANDLOADER Magazine, Volume 9, Number 6 (1974) pp 26 ff.]

Although the art has long sought propellant compositions which impart high velocities without the high pressure characteristic of smokeless powder, no commercially acceptable substitute for the well-known "black powder," without its inherent disadvantages discussed above, has heretofore been found.

SUMMARY OF THE INVENTION

In its composition aspects, our invention relates to novel gas producing deflagrating compositions useful for producing propulsion to projectiles for use in firearms, munitions, pyrotechnics, and the like, and, in its process aspects, to methods for preparing said compositions. The compositions of our invention offer the advantages of being safer to handle and manufacture and producing more efficient propulsion to projectiles than do compositions in the prior art; that is, they tend to produce higher projectile velocities with lower pressures than compositions heretofore known.

DETAILED DESCRIPTION INCLUSIVE OF PREFERRED EMBODIMENTS

In one of its composition of matter aspects, the present invention relates to a gas generating composition for producing controlled gas pressures which comprises a substantially homogeneous mixture of (a) approximately 30–82.5 parts by weight of an oxygen-containing oxidizing agent, (b) approximately 14.5–45 parts by weight of an organic carboxylic acid or oxidizable derivative thereof, and (c) approximately 1.0 to 25.0 parts by weight of water.

In the above description of this aspect of our invention, the oxidizing agent is one of a large number of oxygen-containing organic or inorganic compounds which tends to cause the rapid oxidation or deflagration of a fuel or reducing agent without the requirement of the presence of oxygen from the atmosphere. Preferred oxygen-containing oxidizing agents are solid materials at ambient temperatures, but as will be seen in the disclosure below, the solid state is not a requirement of the gas-forming mixtures of our invention. Thus, even liquid oxidizing agents are operable in our invention.

Examples of suitable oxygen-containing oxidizing agents within the scope of our invention include, but are not limited to, inorganic nitrates, such as ammonium nitrate; the alkali metal nitrates, for example, sodium nitrate, potassium nitrate, and the like; the alkaline earth nitrates, for example, calcium nitrate, barium nitrate, and the like; heavy metal nitrates, for example, lead nitrate, ferric nitrate, cupric nitrate, and the like; organic nitrates, for example, urea nitrate, guanidine nitrate, and the like; inorganic perchlorates, such as ammonium perchlorate; alkali metal perchlorates, for example, potassium perchlorate, sodium perchlorate, lithium perchlorate, and the like; alkaline earth perchlorates, for example, calcium perchlorate, magnesium perchlorate, barium perchlorate, and the like; heavy metal perchlorates, for example, lead perchlorate, ferrous perchlorate, cupric perchlorate, cobaltous perchlorate, and the like; inorganic chlorates, for example, ammonium chlorate; alkali metal chlorates, for example, sodium chlorate, potassium chlorate, lithium chlorate, and the like; alkaline earth chlorates, for example, calcium chlorate, magnesium chlorate, and the like; heavy metal chlorates, for example, cupric chlorate, lead chlorate, and the like; alkali metal permanganates, for example, ammonium permanganate; alkali metal permanganates, for example, sodium permanganate, potassium permanganate, and lithium permanganate; alkaline earth permanganates, for example, calcium permanganate, magnesium permanganate, and barium permanganate, and other metallic permanganates, for example, aluminum permanganate.

Particularly preferred oxidizing agents useful in the compositions of our invention are ammonium perchlorate, the alkali metal perchlorates, for example, sodium perchlorate, potassium perchlorate, and lithium perchlorate; ammonium nitrate and the alkali metal nitrates, for example, sodium nitrate, potassium nitrate, and lithium nitrate. These materials are readily available, are relatively inexpensive, and are comparatively stable and safe to handle.

In this aspect of our invention, an organic carboxylic acid or oxidizable derivative thereof is an aliphatic, aromatic, heterocyclic, cyclo-aliphatic, saturated or unsaturated carboxylic acid, R—COOH or derivative thereof wherein R is a monovalent organic radical which may be straight- or branched- chain aliphatic of from two to about six carbon atoms and which may be saturated or unsaturated; aromatic having from one to about three carbocyclic or heterocyclic aromatic rings, preferably of five or six members in each ring; or cyclo-aliphatic which may be fully saturated or unsaturated and may contain heteroatoms.

Where R in the above formula is aromatic the aromatic ring or rings may be unsubstituted or substituted by from one to about four substituents which may be positioned in any of the available positions in the ring or rings relative to the carboxylic acid group or derivative thereof. Examples of substituents on said rings included within our invention include, but are not limited to, lower alkyl of from one to three carbon atoms, for example, methyl, ethyl, propyl and the like; hydroxy; amino; substituted amino, including one or two lower alkyl and monocyclic aryl substituents; carboxy, nitro, lower-alkoxy of from one to about three carbon atoms, nitroso, and the like.

Examples of the above described carboxylic acid, R—COOH, from which suitable derivatives may be derived, include, but are not limited to, benzoic acid, salicylic acid, anthranilic acid, p-nitrobenzoic acid, m-toluic acid, p-ethylbenzoic acid, vanillic acid, resorcylic acid, α-naphthoic acid, 3-hydroxy-2-naphthoic acid, 1-phenanthroic acid, 1,8-naphthalenedicarboxylic acid, phthalic acid, isophthalic acid, terephthalic acid, and the like; acetic acid, propionic acid, n-butyric acid, caproic acid, isovaleric acid, 2-butenoic acid, maleic acid, succinic acid, glycine, lactic acid, phenylglycine, cyclohexanecarboxylic acid, 4-methylcyclohexanecarboxylic acid, cyclopentanecarboxylic acid, citric acid, tartaric acid, tartronic acid, malonic acid, and the like.

Oxidizable derivatives of said organic carboxylic acids are compounds wherein the acidic function of the carboxylic acid functional group has been replaced by another functional group which does not interfere with the oxidizable properties of the molecule as a whole. We have found that a wide range of derivatives are useful for the purpose of our invention; for example, ammonium and metallic salts of said carboxylic acids, amides, esters (particularly but not necessarily, solid esters), hydroxamic acids, anhydrides, hydrazides, all of which may be unsubstituted or substituted where applicable.

Surprisingly, it has been found that especially useful derivatives of said oxidizable carboxylic acids are the ammonium and metallic salts thereof. Said salts are ordinarily stable solids which are either commercially available or are easily prepared by known methods.

Particularly preferred salts of said carboxylic acids are the ammonium and alkali metallic salts of aromatic carboxylic acids as above defined. For example, ammonium benzoate, sodium benzoate, potassium benzoate, sodium salicylate, potassium salicylate, lithium p-hydroxybenzoate, potassium anthranilate, ammonium m-nitrobenzoate, disodium phthalate are especially useful fuels for the deflagrating compositions of our invention.

An especially preferred oxidizable carboxylic acid derivative of our invention is sodium benzoate, which is readily available, is inexpensive, and produces excellent results in our compositions, as described below. Sodium benzoate also presents the added advantage that it is a corrosion inhibitor for ferrous metals, and this imparts corrosion-inhibitive action to the composition of our invention.

In another of its composition aspects, our invention comprises a mixture of the above described composition (i.e., an oxidizable carboxylic acid or oxidizable derivative thereof, an oxygen containing organic or inorganic oxidizing agent and water), in intimate combination with the normal ingredients and proportions of black powder, i.e., about 75 parts of potassium nitrate, about 10 parts of sulfur, and about 15 parts of charcoal, all parts being by weight.

We have found, surprisingly, that a range of mixtures of said ingredients from about 20 percent to about 50 percent by weight of the composition described in the first aspect of our invention and from about 50 to 80 percent by weight of the ingredients of ordinary black powder produce a gas producing deflagrating composition with significantly improved burning properties over those of black powder per se. The improvement is all the more surprising because of the presence of relatively large amounts of water in the composition, which heretofore has been found to be detrimental to black powder alone.

In accordance with a first process aspect, our invention relates to a method for preparing gas-producing deflagrating compositions which comprises the steps (a) intimately mixing an oxygen containing oxidizing component and an organic carboxylic acid or oxidizable derivative thereof with sufficient water to produce an intimate blendable mass, and (b) removing water until the water content of the mixture is from about 1.0 to about 20 percent by weight depending on the end use. By employing sufficient water in the first step of this process the ingredients can be intimately blended in readily available equipment which are well known to the blending arts, for example ribbon blender, sigma-blade dough mixers, tumble blenders, and the like.

The second step of our process is carried out by drying means, i.e., by the application of heat, by passing dry air over the blended materials, by applying vacuum to the blended materials, or by a combination of any of the foregoing.

In a second process aspect of our invention, there is provided a method for producing gas-forming deflagrating compositions which comprises (a) intimately mixing an oxygen-containing oxidizing agent, an organic carboxylic acid or oxidizable derivative thereof, potassium nitrate, powdered charcoal, and sulfur with sufficient water to yield a blendable mass, and (b) removing water until the water content of the mixture is from about 0.6 to about 6.0 percent by weight. The means for blending and removing water according to this process aspect are the same as those disclosed above in the prior process aspect of our invention.

In addition to the above-named components as requisites in the compositions of our invention, there may also be incorporated therein the various adjuvants known to the art of propellants for their modifying the cohesiveness of the particles, the surface characteristics and the ballistic characteristics as may be desired. Examples of such adjuvants which may be incorporated in the compositions of our invention include binders, for example, dextrine, gum arabic, hydroxymethyl cellulose, hydroxyethyl cellulose, hydroxypropyl cellulose, gum tragacanth, red gum (acaroid resin), guar gum, and the like; stabilizers, for example, diphenylamine, diethyldiphenylurea (Centralite I), N,N-diphenylurea, diphenylurethane, 2-nitrodiphenylurea, and the like; coolants, for example, nitroguanidine, potassium bitartrate, sodium bicarbonate, hydrocellulose, anthracene, starch, dibutylphthalate, and the like; chemicals which can produce additional water in the combustion products, for example sucrose, polyvinyl alcohol, paraformaldehyde, sodium borate, urea, urea nitrate, guanidine carbonate, melamine, and the like, which can provide hydrogen or oxygen or both during the oxidation process; and catalysts known to the art, for example, sulfur, copper chromite, ferric oxide, copper phthalocyanine, and the like.

It will be apparent to one skilled in the art that a particularly striking feature of our invention is the requirement of the presence of water as a component of our deflagrating composition. The prior art teaches that water is deleterious both to black and smokeless powder. Certain blasting or explosive compositions are known, such as taught, for example, in U.S. Pat. No. 3,449,181, which comprise an aqueous slurry of an oxidizing agent containing organic fuels. However, the compositions provided by this invention are not explosives; that is, they do not detonate, but rather burn in conformance with the term "deflagrating."

Water has also been found to sensitize certain explosive mixtures employing inorganic oxidizing agents in the presence of aluminum metal, as disclosed in U.S. Pat. No. 3,366,053.

It is not fully understood why water is essential in our compositions, but it has been demonstrated that removal of water from the compositions renders them useless for the purposes of the invention. For example, removal of water from the compositions causes the pressure to "spike;" that is, to produce high pressure immediately upon ignition which is undesirable in a propellant composition. Thus, the presence of water in compositions has been demonstrated to control the burning rate, while acting as a coolant and also providing water vapor which acts as an effective propulsive gas. It is believed that the unique thermodynamic properties of water render it ideally suited for the purposes accomplished. Moreover, the use of water in the manufacture of our compositions renders the process much safer and simpler than otherwise attainable. For example, in the presence of the ionic salts representing the oxygen-containing oxidizing agents, the water component is a good electrolyte, thus decreasing substantially the charges of dangerous electrostatic charges building up.

The compositions of our invention are useful as gas-forming deflagrating materials; that is, when ignited under conditions of controlled confinement, they burn rapidly and without detonation to produce large quantities of gaseous by-products. Thus, the compositions are useful as propellants for firearms and firearms ammunition, for military munitions, for example, in cannon, mortars, rockets, and the like, for igniters and fuses, and for pyrotechnic devices requiring a propelling force.

The following Examples serve to illustrate our invention without limiting it thereto. In each Example parts are given as parts by weight.

EXAMPLE 1

In a laboratory model tumble blender were placed 45 parts of finely divided potassium nitrate, nine parts of powdered hardwood charcoal, 6 parts of powdered sulfur, 19 parts of potassium perchlorate, 11 parts of sodium benzoate, six parts of dicyandiamide, and four parts of dextrine. The blender was rotated to thoroughly mix the ingredients, and then 12 parts of water were added as a spray while the materials were being continually tumbled. The charge was tumbled for 5 minutes, and then stopped, and 0.5 parts of micronized N,N'-ethylene-bis-stearamide wax, and 0.5 part of graphite were added. The tumbling action was again started and continued for 15 minutes. The charge was then removed and air dried at 150° F. until the moisture on an Ohaus Moisture Determining Balance (Model #6100-00) indicated that the total moisture content was 1.0 percent. The product was screened through standard screens and that portion which passed through 14 mesh and not through 40 mesh screens was retained.

Testing Data

The burning characteristics of above-described deflagrating composition were determined by firing the composition in a specially adapted rifle firmly secured at the breech and fitted with a pressure transducer fitted into the back of the chamber. The transducer output was connected to a storage oscilloscope. A pressure-time curve was displayed on the cathode ray tube as shown as curve A in FIG. I, where pressure is read as the ordinate (X) and time as the abscissa (Y).

A charge of 80 grains of the composition described in this Example was fired with a percussion cap primer. The peak pressure reading was found to be 7837 psi gauge for an average of 10 firings. In a parallel experiment, commercial black powder (FFFg grade) (Curve B in FIG. I) gave a peak pressure reading of 10,868 psi gauge for an average of 10 firings for an identical weight of powder.

The "muzzle velocity" of the bullet fired in each case was simultaneously measured by an electronic chronograph beginning at 5 feet from the muzzle of the barrel. The composition of Example 1 imparted an average velocity of 1795 feet per second (fps) to a 176 grain lead bullet, and the commercial black powder imparted an average velocity of 1657 fps to the same weight bullet.

EXAMPLE 2

A propellant composed of 60 parts of potassium perchlorate, 40 parts of sodium propionate, 10 parts sulfur, 5 parts dextrine, and 10 parts of water was granulated in a rotating coating pan and was dried to 4.3% water content. Tests carried out as described above showed that this composition gave a peak pressure of 10,500 psi gauge and a muzzle velocity of 1494 fps.

EXAMPLE 3

A composition comprising 70 parts of potassium perchlorate, 30 parts of sodium benzoate and the following percentages of water gave ballistic results as indicated in the following table:

| % $H_2O$ | Peak Pressure p.s.i. gauge | Time to Peak Pressure in microseconds | Muzzle Velocity in feet/second |
|---|---|---|---|
| 2% | 25,000 | 100 | 1650 |
| 5% | 18,000 | 100 | 1700 |
| 10% | 10,000 | 100 | 1577 |
| 15% | 7,000 | 800 | 1310 |
| 25% | 2,500 | 2000 | 1231 |

All loadings were in a 0.222 commercial cartridge with a 53 grain bullet. At 25% water, the mixture is a slurry.

EXAMPLES 4–8

In a similar manner, compositions having the proportions shown in Table I were prepared and found to have satisfactory deflagration properties in accordance with the invention:

TABLE I

| Example No. | Reducing Agent | Parts | Parts of $KC10_4$ | Parts of $H_2O$ |
|---|---|---|---|---|
| 4 | Benzoic acid | 20 | 80 | 2 |
| 5 | Sucrose benzoate | 20 | 75 | 2 |
| 6 | Lithium benzoate | 45 | 55 | 5 |
| 7 | Calcium benzoate | 40 | 60 | 4 |
| 8 | Isatoic anhydride | 25 | 75 | 2 |

EXAMPLE 9

In a similar manner, the compositions prepared by blending 75 parts of potassium nitrate, 15 parts of sodium benzoate, 10 parts of sulfur and 3 parts of water had an excellent velocity-pressure ratio.

We claim:

1. In a deflagrating gas generating composition for producing controlled gas pressure which imparts high velocity to projectiles at relatively low peak pressure, the improvement which comprises employing, as the essential gas-producing elements, approximately 82.5–30 parts by weight of an oxidizing agent selected from the group consisting of ammonium, alkali metal, and alkaline earth nitrates, chlorates and perchlorates; approximately 14.5–45 parts by weight of an oxidizable derivative of an organic carboxylic acid selected from the group consisting of ammonium and alkali metal salts of aromatic carboxylic acids; and approximately 25–1.0 parts by weight of water.

2. A composition according to claim 1, wherein the oxidizing agent is an alkali metal or ammonium perchlorate.

3. A composition according to claim 1, wherein the oxidizing agent is potassium perchlorate and the organic carboxylic acid derivative is sodium benzoate.

4. A composition according to claim 1, consisting of approximately 50–80 parts of potassium perchlorate, approximately 14.5–45 parts of sodium benzoate and approximately 1–25 parts of water.

5. A composition according to claim 1 which consists of 75 parts of potassium nitrate, 15 parts of sodium benzoate, 10 parts of sulfur and 3 parts of water.

6. A composition according to claim 1 which consists of from 20 to 50 percent of the composition claimed therein admixed with from 80 to 50 percent of the components of black powder.

7. A composition according to claim 6 which consists of 45 parts of potassium nitrate, 9 parts of charcoal, 6 parts of sulfur, 19 parts of potassium perchlorate, 11 parts of sodium benzoate, 6 parts of dicyanamide and from 1 to 4 parts of water.

8. The process for preparing a composition according to claim 1 which comprises intimately mixing an oxidizing component selected from the group consisting of ammonium, alkali metal, and alkaline earth nitrates, chlorates and perchlorates with an organic reducing or fuel component selected from the group consisting of ammonium and alkali metal salts of aromatic carboxylic acids in the presence of excess water, reducing the water to a range of 1.0 to 25.0 percent by weight, and recovering the resulting composition.

* * * * *